United States Patent [19]

Norris et al.

[11] 4,118,842

[45] Oct. 10, 1978

[54] WEAVE-DE-WEAVE PROCESS

[75] Inventors: Alan H. Norris; Phillip W. Chambley, both of Rome, Ga.

[73] Assignee: Champion International Corporation, Stamford, Conn.

[21] Appl. No.: 813,871

[22] Filed: Jul. 8, 1977

[51] Int. Cl.[2] ..... D02G 1/00; D02H 9/00

[52] U.S. Cl. ..... 28/218; 28/171; 28/198; 139/435; 139/440

[58] Field of Search ..... 139/435, 440; 28/218, 28/198, 171, 100

[56] References Cited

U.S. PATENT DOCUMENTS

| | | | |
|---|---|---|---|
| 1,368,691 | 2/1921 | Brooks | 139/435 |
| 3,039,169 | 6/1962 | Frickert, Jr. et al. | 28/100 |
| 3,536,019 | 10/1970 | Honda et al. | 28/198 X |
| 3,595,276 | 7/1971 | Wrzesien | 139/440 X |
| 3,605,225 | 9/1971 | Gibson et al. | 28/218 |
| 3,793,816 | 2/1974 | Kodama | 28/218 X |
| 3,930,357 | 1/1976 | Gibson | 28/171 X |
| 3,997,950 | 12/1976 | Gibson | 28/218 |

FOREIGN PATENT DOCUMENTS

| | | | |
|---|---|---|---|
| 4,720,494 | 9/1972 | Japan | 28/218 |
| 3,020 of | 1853 | United Kingdom | 28/218 |

*Primary Examiner*—Robert R. Mackey
*Attorney, Agent, or Firm*—Evelyn M. Sommer

[57] ABSTRACT

A weave-de-weave process in which a plurality of weft loops are fluidly injected from opposite sides and normal to a plurality of warp yarns to form a composite tape. The tape is deweaved after the warp is space dyed by splitting the interior of the tape to expose the looped ends of the weft.

7 Claims, 6 Drawing Figures

WEAVE-DE-WEAVE PROCESS

BACKGROUND OF THE INVENTION

1. Field of the Invention

This invention relates to a process and apparatus for weaving and deweaving a fabric tape so the individual warp strands may be space dyed and wound onto separate packages for subsequent use. Deweaving the tape is an essential process when space dyeing of textile yarns is carried out via the weave-de-weave process, since the tapes themselves cannot be used as a unit for further processing.

2. Description of the Prior Art

U.S. Pat. No. 3,605,225 describes in detail a weaving process which is commonly referred to as "weave-de-weave." Weft is inserted by a needle on a narrow width needle loom and knitted in a chain stitch along one side of a tape fabric including a plurality of warp threads in order that the weft can subsequently be removed after treatment of the fabric, e.g., by coloring, and the fabric unravelled to provide a yarn with intermittent coloring or splotches which is then used as pile yarn in carpets.

As the weft is removed, the individual warp yarns from the tape are separated out and wound on single one-end packages.

Typically, the yarn used for the weft filling is either nylon or polyester of a size substantially smaller than the warp yarn through which it is woven. For purposes of economy, the weft yarn must be reclaimed for repetitive use and with each re-use, the coat of the weft per pound of carpet yarn produced is decreased. However, there are serious drawbacks in re-using the weft yarn. Owing to its fine denier and to repeated subjection to both heat (during dyeing) and stress (during weaving and deweaving), the efficiency of the latter operations decrease with each re-use.

One problem associated with weft removal in the "weave-de-weave" process, therefore, is breakage of the weft thread or the presence of a knot or tangle in the weft thread as it is deweaved. This problem is compounded by the method of weft collection in which the use of a conventional ring traveler take-up is involved, which inserts variable twist in the weft end, consequently increasing the incidence of breakage and snarls in re-use of the weft. If the weft breaks or tangles, the deweaving process must stop. Broken ends must be rethreaded and repaired, and yarn tensions readjusted, all of which gives rise to considerable process inefficiency and additionally requires operator attention.

Knots and tangles, as well as breakage, of the warp threads in the process is also a problem because of the simultaneous winding of a large number of parallel yarns onto separate packages. If a knot, tangle, or breakage of a warp thread occurs, the individual warp threads cannot be properly separated, and the entire process must stop.

The loom speed in the conventional weave-de-weave process is also limited to about 1000–1200 picks per minute. Each pick, or weft insertion, can be spaced only about 1 inch from the adjacent picks, a distance limited because the movement of warp per pick is all the loom gearing allows. If the gearing limitation is removed, the warp advance per pick is still limited by the fact that the weft is wrapped around the selvage knitting needle and cannot easily be pulled through. Since the weft is fragile for economic reasons, e.g., due to its continued removal and reuse, this further limits the speed of warp production.

Further, the weft can only be withdrawn from the fabric in a reverse operation to its insertion, so that the tape must at some point in the process be reversed end for end. The tape produced is narrow ($2\frac{1}{2}$ – 3 inches) and this gives rise to problems in keeping the tape free from folds. Lastly, even with due care the weft often breaks causing the deweaving process to stop, since the weft must be pulled out.

The weave-de-weave system described herein resolves some or all of these difficulties. The advantages of our method and apparatus over the prior art include the following:

(1) Wider tapes may be made on the loom since the weft insertion system employed is not the needle arm knitting needle type which can only be used over a few inches;

(2) Wider tapes mean less chance of folds in processing;

(3) While one can have wider tapes in dyeing, the tapes can be split down to any size for winding back to packages;

(4) The tapes do not need reversing and will deweave in either direction;

(5) The deweaving does not require a continuous weft. Weft breaks do not stop the deweaving process;

(6) There is no limitation on pick spacing imposed by the loom; and (7) The system allows a continuous unwinding of weft from the supply package. Accordingly, the present invention provides a weave-de-weave process and apparatus characterized by increased speed and operating efficiency.

SUMMARY OF THE INVENTION

These objectives and advantages are achieved by inserting the weft between the warp from opposite sides of the tape using an air gun. The picks are not knitted to each other, but are interweaved with the warp and alternated to either form a selvage along opposite edges of the tape or an overlap, for a portion of adjacent lengths, along the longitudinal center of the tape.

The weft is withdrawn in a controlled manner from its supply package continuously in loops prior to each insertion in the warp by the air gun. This greatly reduces variations in weft tension and potential breakage. Because knitting needles are not employed to form the tape and insert the weft, the tape formed by the process of the present invention may be substantially wider than a conventional tape, reducing the chance of folds forming in the tape. The air jet system employed to weave the weft into the warp is the most rapid system of weft insertion found to date and there is no limitation on the pick spacing imposed by the loom.

After dyeing, the tape is separated into two or more tapes by driving it past a pulley mechanism, which causes the tape to diverge about it. This splits the tape apart, exposing the looped ends of each weft pick. The exposed looped ends of each weft pick are caught by the pulley mechanism and pulled from the warp and deposited in a suitable container wherein they can be remelted and reextruded for reuse, or merely rewound into packages.

Because of the method used for removing the weft, the removal of the weft does not depend on weft continuity, as in the prior art, and thus will work equally as well with broken weft. No reversal of the tape is required to remove the weft, which results along with weft breakage in the prior art, in substantial downtime of the deweaving apparatus.

The tape can be split down into any number of tapes for convenience of handling and rewinding the warp back to packages.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
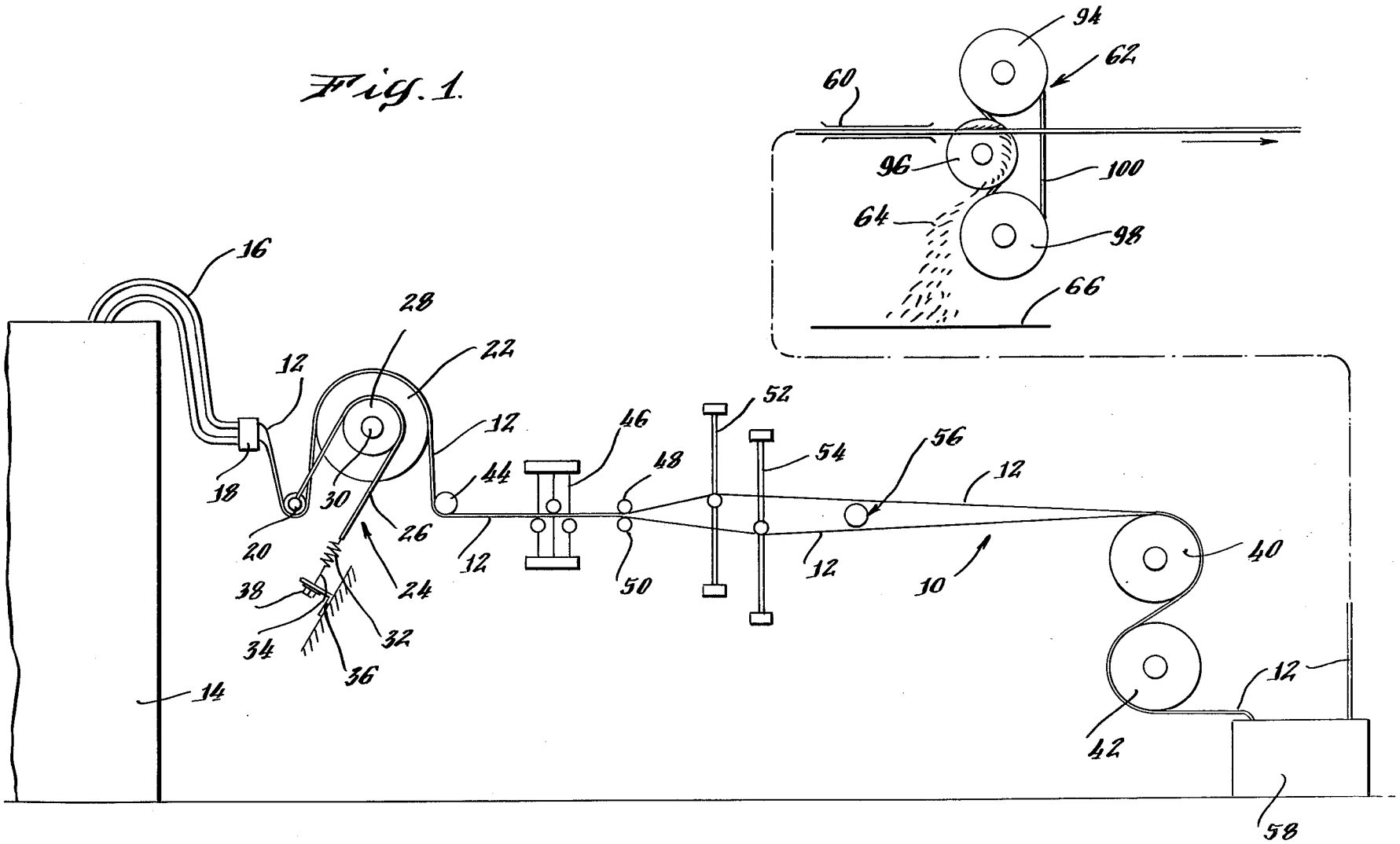
FIG. 1 is a diagrammatic side view of the weave-de-weave apparatus of the present invention.

Referring now to the drawings in detail, wherein like numerals indicate like elements throughout the several views, the weave-de-weave apparatus of the present invention is illustrated diagrammatically in FIG. 1.

Warp yarns 12 are fed continuously from a creel 14 containing yarn packages down guide tubes 16, through an eyeplate 18 and about a pressure roller 20. The warp yarns 12 are forced to turn about a drum 22 against the restraining influence of a braking mechanism 24, which can be adjusted to vary the tension on the warp yarns 12 being withdrawn from creel 14.

Brake mechanism 24 includes a flexible belt 26 having one end connected about the shaft of pressure roll 20 and entrained about a drum 28 coaxially mounted on shaft 30 rotatably carrying drum 22. The other end of belt 26 is connected to a coil spring 32 fixed to a bolt 34 received through the arm of a bracket 36 mounted on the frame of the apparatus. Bolt 34 is threadedly received through a nut 38.

By rotating nut 38, the tension exerted by spring 32 on belt 26 and consequently its frictional engagement with brake drum 28 can be varied, varying the freedom of feed rotation of drum 22 about its circumference on yarns 12, and consequently the tension applied to the yarns 12 by a pair of draw rolls 40, 42 downstream from drum 22, drawing the yarns along the apparatus.

The tensioned yarns 12 pass beneath a second pressure roll 44 and between a conventional yarn detector system 46 which serves as a stop motion for the apparatus upon sensing a missing warp end. Yarns 12, downstream from detector 46, pass between a pair of bars 48, 50 which serve as lift stops for warp yarns 12 during the shedding action imparted to the yarns by conventional heddles 52, 54, which alternately lift and spread the adjacent warp yarns for insertion of the weft therebetween at a weft insertion station 56, as will be described hereinafter.

After the weft is inserted, the composite tape (warp and weft) is drawn and pulled by rolls 40 and 42 and fed to storage containers or the dyeing machinery, After dyeing, the dyed tape is passed through a guide 60, split into one or more tapes at a weft removal station 62, as will be described hereinafter, and the weft removed by a pulley mechanism 62, which strips the weft 64 and deposits it for rewinding or remelting in a container 66.

In the conventional weave-de-weave process, the weft filling 64 is inserted by a needle and knitted in a chain stitch along one side of the tape fabric between a plurality of warp threads 12 to form a unitary selvage. After treatment of the fabric tape by dyeing, the weft 12 is unwoven and removed by pulling an end to unravel the picks. The chain stitch selvage enables ready removal of the weft. The warp threads are wound into individual packages for reworking, and the weft is collected in a suitable receptacle for reuse or disposal. The weft insertion system of the present invention at station 56 utilizes an entirely different process for the weft insertion, eliminating the knitting of the weft through the warp.

Figure 2:
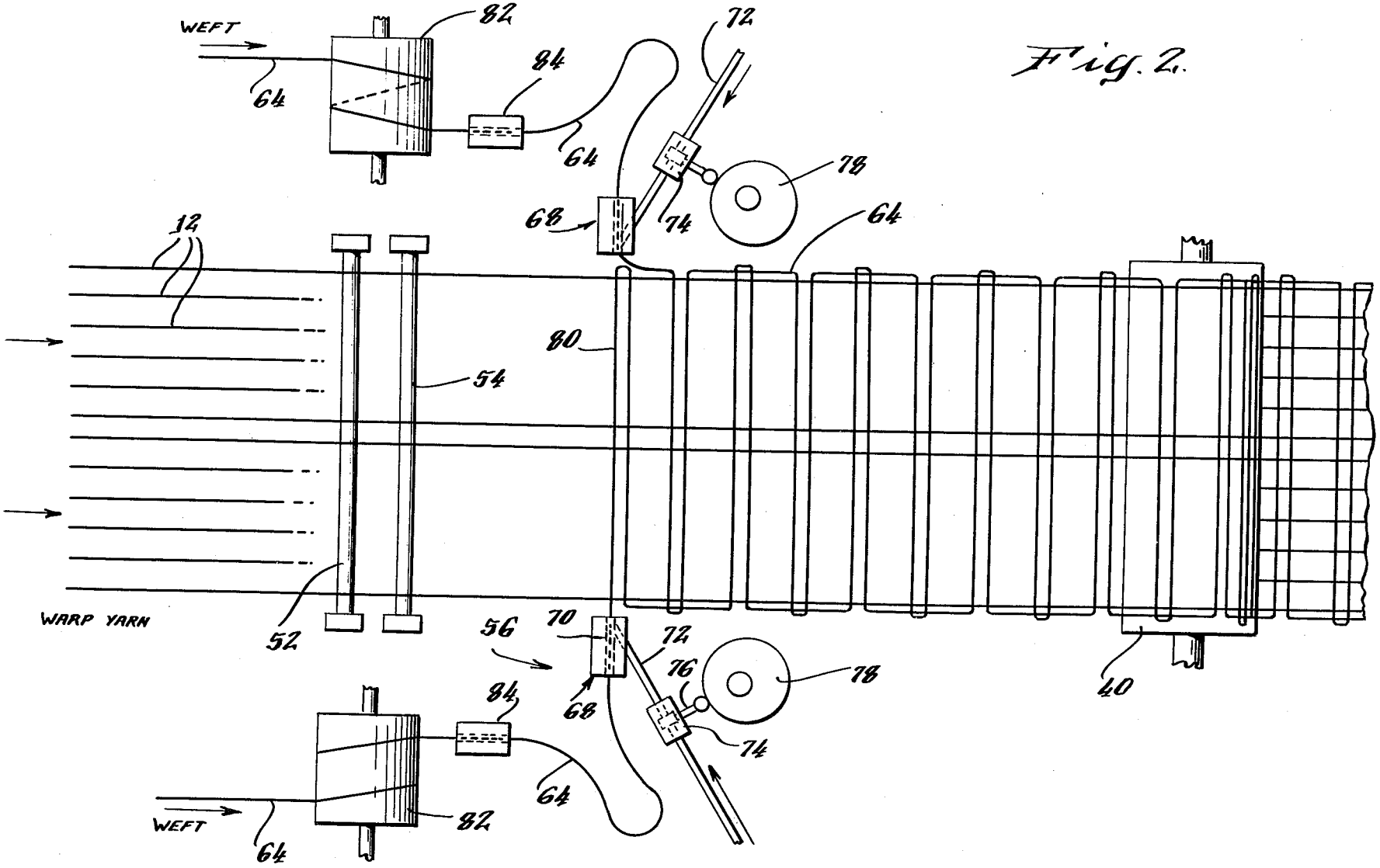
FIG. 2 is a diagrammatic plan view of a portion of the apparatus of FIG. 1 at the weft insertion station.

With specific reference to FIG. 2, a weft propulsion air gun 68 is provided on opposite sides of the tape at station 56. The gun 68 includes a bore 70 receiving a weft strand 64 therethrough. A fluid jet 72 controlled by a poppet valve 74 joins bore 70 at an acute angle. Poppet valve 74 is operated by a shutter arm 76 which rides on the circumference of an eccentrically mounted cam 78. When the high side of cam 78 contacts arm 76, valve 74 will open admitting air to bore 70 to push the weft 64 across the tape between the warp 12. Cam 78 may have more than one high lobe to operate valve 74 more than once during each revolution of cam 78 depending on the speed of the tape and number of picks per inch desired to be woven.

As shown in FIG. 2, weft 64 is inserted alternately from each side of the tape in a continuous loop 80, interweaving with the warp 12 due to the shedding action of the heddles 52, 54. The weft is fed from a feed wheel 82 which pulls the weft from a weft supply package and by an aspirator 84 which pulls the weft from wheel 82 to each air gun 68. The aspirator 84 prevents weft wraps on wheel 82. The aspirator 84 deposits the weft yarn 64 in a loose loop awaiting the next operation of the weft insertion air gun 68.

In contrast to the prior art system, the weft withdrawal from the package is continuous rather than intermittent. This greatly reduces variations in weft tension and potential breakage. The effective circumference of yarn feed wheel 82 can be increased or decreased to ensure that the exact amount of weft yarn is fed for each cycle of the apparatus. The air jet weaving of the weft provides a more rapid method of weaving the picks than was available heretofore, and provides flexibility in placing of the picks along the tape.

In this invention, only one tape of double normal width and using the same number of warp ends as both tapes, is woven. Further, the conventional tape loom has two tapes woven side by side, sharing the stop motion and shedding system but having separate right and left hand weft insertion systems. This eliminates the folding problem associated with tapes formed on a narrow width needle loom.

Figure 3:
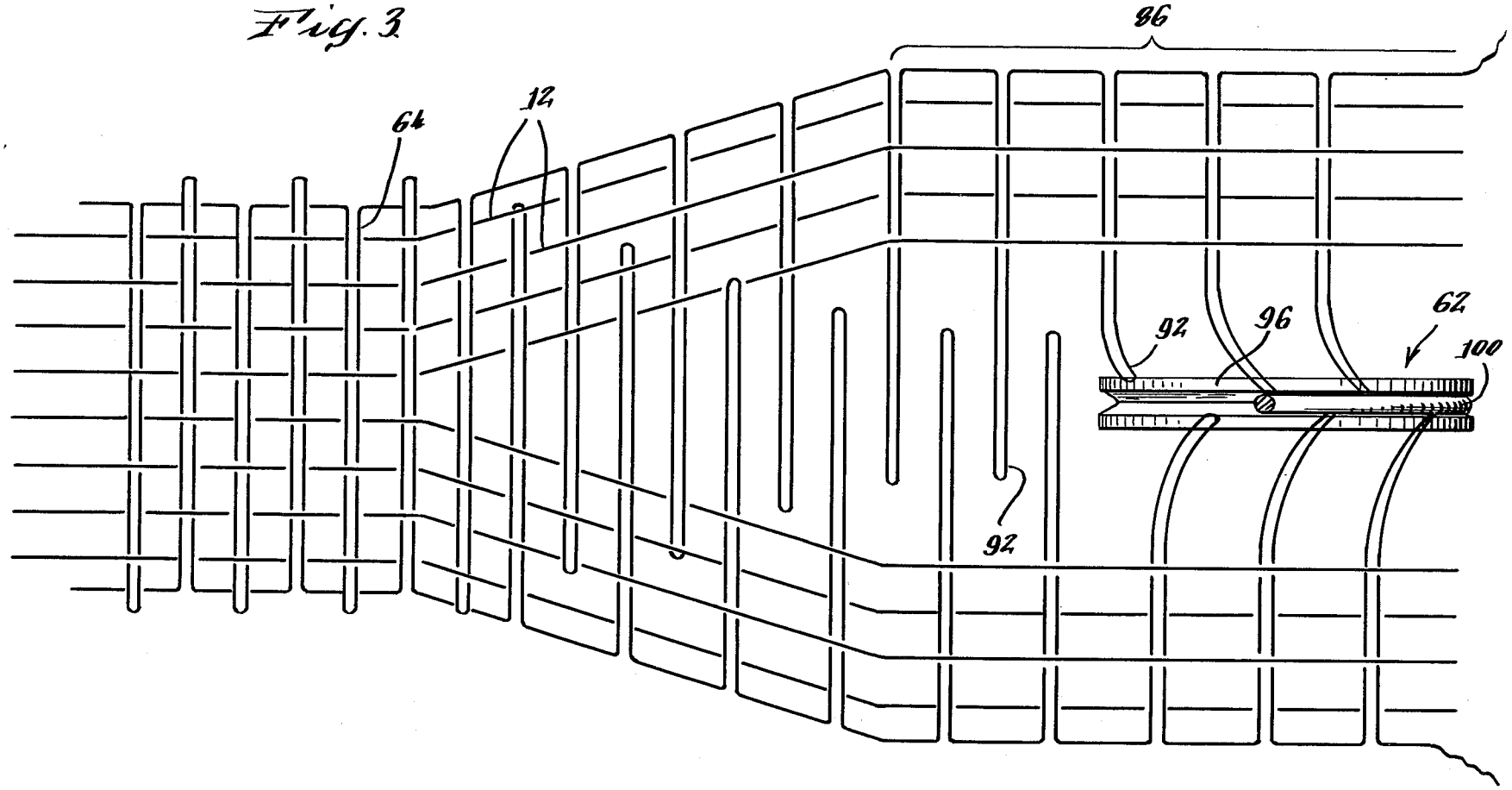
FIG. 3 is a top plan view of another portion of the apparatus of FIG. 1 at the weft removal station.

The relative timing of the weft insertion air guns 68 and the heddle shedding action can be varied to produce different tape constructions. Referring specifically to FIG. 3, it will be seen that the weft is fed from both sides alternately and the weft loop protrudes from the edge of the tape for a short distance. In practice this could be in a range of ¼ to 6 inches, depending on the required speed of production and stability of the tape. Each side picks alternately so that the speed of operation of the weft feed mechanism is half the number of picks per minute. Each weft loop is always in the same position relative to the warp ends. The left hand weft pick always is over the first warp end (or always under-)—never under and over alternately as in normal weaving. This enables the tape to be split as shown in FIG. 3 wherein the weft 64 can be readily pulled out from between the warp 12, without tangling or knotting.

Figure 6:
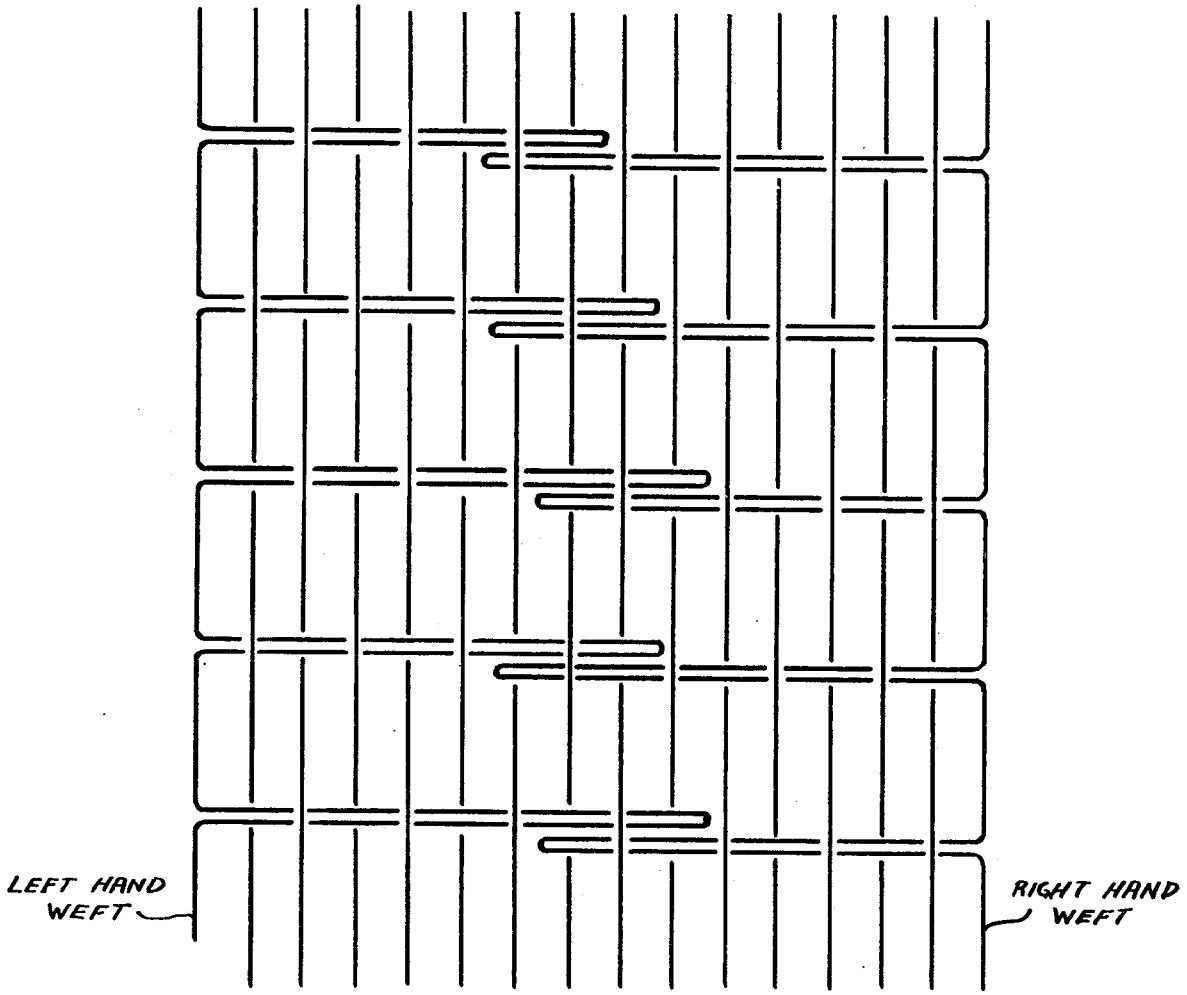
FIG. 6 is a top plan view of an alternate form of fabric tape which can be deweaved in accordance with the principles of the present invention.

Alternatively, a pick can be inserted at each shed opening by each air gun 68 extending slightly beyond the center line of the tape as shown in FIG. 6. The picks overlap in the center to the extent necessary to give cohesion between the two tapes in processing. This provides for a faster picking rate at the loom which may or may not be advantageous but separation of weft is much easier.

In either construction, the deweaving of the tape is easier than in the prior art, and it has the tremendous advantage that the tape will deweave from either end thus avoiding having to reverse the tape container end for end as in the prior art. This allows use of much larger tape containers, avoids tangles and makes filling the container less exacting.

Figure 5:
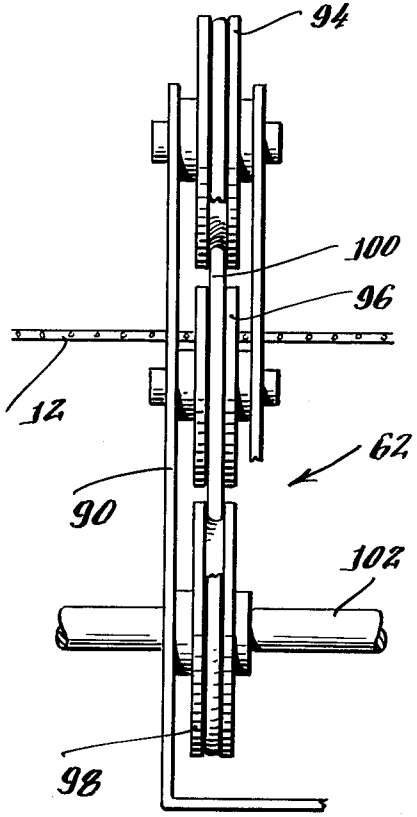
FIG. 5 is an end view in elevation of the mechanism of FIG. 4 as seen from the right-hand side of FIG. 4.
Figure 4:
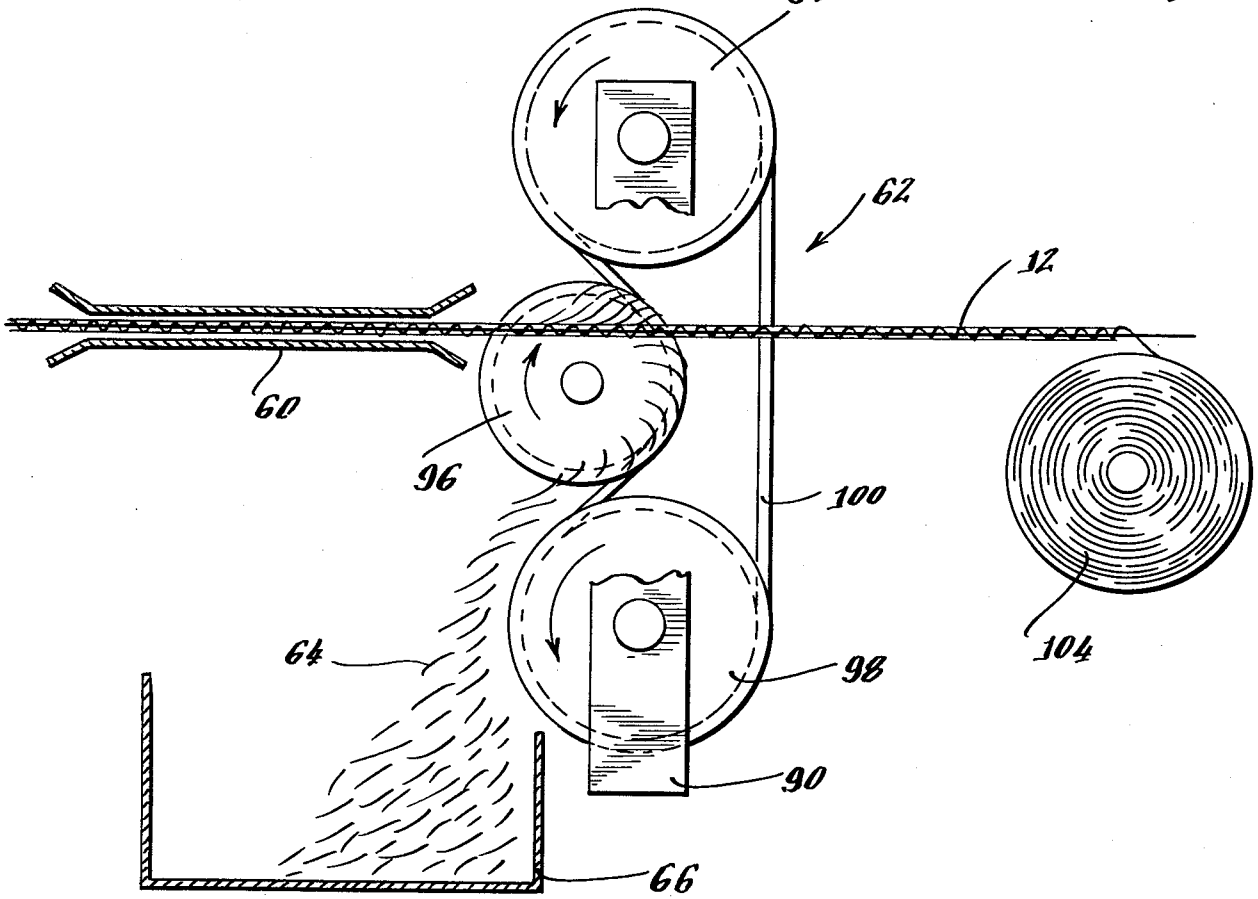
FIG. 4 is a side view in elevation of the weft removal mechanism at the weft removal station illustrated in FIG. 3.

After dyeing in bath 58, the tape is split as shown in FIGS. 3 to 5. The section 86 is no longer a woven structure. Examining each warp end will show that the warp 12 always stays on the same side of the residual weft 64. If the warp ends are parted in a direction at right angles to their direction of travel, the weft thread is unattached and will fall out.

Accordingly, the weft removal mechanism 62 is positioned at the exit of the warp dye line where the double tape exists. The tape is split at its center line by passing it through guide 60 and causing the warp to travel about either side of the frame 90 of mechanism 62, exposing the looped ends 92 of the weft 64, which dangle from the inner sides of the split tape. Frame 90 rotatably mounts three pulleys 94, 96 and 98 drivingly connected by a belt 100. Pulley 98 is rotatably driven through its shaft 102 such that belt 100 will drive pulley 94 and 96 at a peripheral speed several times the speed of the tape.

The dangling, exposed looped ends 92 of the weft 64 extend across the face of middle pulley 96, which will contact the looped ends and carry them successively upwardly between the V-grooves and belt 100 in pulley 96 and then downwardly around pulley 98, stripping the weft 64 from the warp 12 and depositing the stripped weft in container 66. The warp 12 is then wound on separate package 104. Since the pulleys run faster than the tape, the weft is pulled out in the same direction as the tape is running.

The weft removal mechanism 62 does not depend on weft continuity and will work equally well with broken weft, as successive looped ends 92 are gripped by the pulleys. There is also no restriction to only two tapes. Separation can be effected into any number of tapes. The restriction on warp ends is only that due to the reed space available and the density required for printing.

What we claim as new is as follows:

1. In a weave-de-weave process in which weft is inserted in a direction normal to a plurality of warp yarns to stabilize the warp by forming a composite tape, and then after treatment of the yarns on the tape, the weft is removed to deweave the tape and the warp is packaged, the improvement comprising the steps of:

fluidly injecting said weft between said warp yarns alternately from opposite sides of said warp in continuous, spaced loops;

laterally splitting the interior of said tape generally parallel to said warp yarns into a plurality of tapes, exposing the looped ends of said weft intermediate the tapes and stripping the weft continuously from said warp to deweave said tapes by successively gripping the exposed looped ends of said weft and pulling said weft from between said warp.

2. In a process in accordance with claim 1 wherein said alternating weft spans all of said warp yarns.

3. In a process in accordance with claim 1 wherein said alternating weft spans approximately half of said warp yarns.

4. In a process in accordance with claim 1 wherein all of said weft loops injected from each side of said warp yarns are all under said first warp yarn on both sides of said tape.

5. In a process in accordance with claim 1 wherein said weft is withdrawn by pulling it continuously from a package to form a loose loop prior to being fluidly injected between said warp.

6. In a process in accordance with claim 1, wherein all of said weft loops injected from each side of said warp yarns are all over said first warp yarn on both sides of said tape.

7. In a weave-de-weave process in which weft is inserted in a direction normal to a plurality of warp yarns alternately from opposite sides of the warps yarns in continuous spaced loops to stabilize the warp by forming a composite tape, and then after treatment of the yarns on the tape, the weft is removed to deweave the tape and the warp is packaged, the improvement comprising the steps of:

laterally splitting the interior of said tape generally parallel to said warp yarns into a plurality of tapes exposing interior looped portions of said weft intermediate the tapes, and stripping the weft continuously from said warp to deweave said tapes by successively gripping the exposed interior looped portions of said weft and pulling said weft from between said warp.

* * * * *